US007396985B1

(12) United States Patent
Roth

(10) Patent No.: US 7,396,985 B1
(45) Date of Patent: Jul. 8, 2008

(54) MUSICAL INSTRUMENT GRIP

(76) Inventor: Thomas J. Roth, 5031 White Post Rd., Bettendorf, IA (US) 52722

( * ) Notice: Subject to any disclaimer, the term of this patent is extended or adjusted under 35 U.S.C. 154(b) by 436 days.

(21) Appl. No.: 10/906,084

(22) Filed: Feb. 2, 2005

(51) Int. Cl.
*G10D 7/10* (2006.01)
*G10D 9/00* (2006.01)

(52) U.S. Cl. ..... 84/387 A; 84/387 A; 84/385 A

(58) Field of Classification Search ..... 84/387 A, 84/385 A
See application file for complete search history.

(56) References Cited

U.S. PATENT DOCUMENTS

| | | | | | |
|---|---|---|---|---|---|
| 853,074 | A * | 5/1907 | Evans et al. | 84/387 R |
| 1,280,325 | A * | 10/1918 | Stewart | 362/396 |
| 1,932,800 | A * | 10/1933 | Myers | 84/385 R |
| 2,765,695 | A * | 10/1956 | Brennan | 84/401 |
| 3,141,369 | A * | 7/1964 | Miccio | 84/387 A |
| 3,437,002 | A * | 4/1969 | DeFauw et al. | 84/453 |
| 3,847,051 | A * | 11/1974 | Miller | 84/387 A |
| 4,348,935 | A * | 9/1982 | Bay | 84/380 R |
| 4,841,829 | A * | 6/1989 | Lehmann | 84/385 A |
| 5,664,758 | A * | 9/1997 | Smith | 248/688 |
| 5,894,098 | A * | 4/1999 | Hsieh | 84/387 A |
| 6,118,059 | A * | 9/2000 | Ternes | 84/387 R |
| 6,504,087 | B2 * | 1/2003 | Shulman | 84/387 A |
| 6,759,584 | B2 * | 7/2004 | Sundstrom | 84/469 |
| 2005/0145094 | A1 * | 7/2005 | Shumake | 84/453 |
| 2006/0196341 | A1 * | 9/2006 | Holtfreter | 84/387 A |
| 2007/0056430 | A1 * | 3/2007 | Lee | 84/395 |

* cited by examiner

*Primary Examiner*—Lincoln Donovan
*Assistant Examiner*—Robert W Horn
(74) *Attorney, Agent, or Firm*—Thomas J. Roth

(57) ABSTRACT

The invention relates to a grip for a musical instrument, particularly a band instrument which may be used in a group performance. A component of every musical performance, especially a group performance by a group such as by a marching band or drum and bugle corps, is the visual component. In the case of a horn, a visually attractive visual component would be a selective spinning or rotating motion provided by the performer, using a grip attached to the horn for allowing support of said horn in a single hand. The grip further provides an ergonomic means for gripping the horn in either one or both hands.

5 Claims, 4 Drawing Sheets

MUSICAL INSTRUMENT GRIP

TECHNICAL FIELD OF THE INVENTION

The invention relates to a grip for a musical instrument, particularly a band instrument which may be used in a group performance.

BACKGROUND OF THE INVENTION

A component of every musical performance, especially a group performance by a group such as by a marching band or drum and bugle corps, is the visual component. Excitement and interest can be generated by additional motion within the group, which typically is provided by a non-playing member such as a drum major or majorette, or a baton performer.

Some instrument players within the group provide a visual component to the performance through the playing of the instrument. The cymbal player, for example, may use broad arm movements to visually accentuate the sound of the instrument. The drum player, such as the tymbale, snare drum, or bass drum player may also use broad arm movements to generate a level of interest in the observer and to provide a level of excitement to the performance.

For the most part, the wind players, hand and arm motions have been limited due to the nature of the instrument. For instruments such as trumpets, bugles and other valve horns, motions are generally limited to those involved with raising and lowering the instrument, prior and subsequent to their playing. The other motions permissible occur during actual playing of the instrument, which can include an exaggerated beat to the music tempo, a circular motion, or other such motion as desired.

In the case of the trumpet or bugle, it has been known to provide a visually exciting component during a non-playing mode. This technique consists of use of an existing ring found on many such horns, engaged by a finger of the user's left hand. So held, a horn may be rotated in a manner similar to a baton, thereby providing some visual interest to the observer. However, this is an ergonomically difficult technique, and its use has been limited due to the risk to the user and the instrument.

SUMMARY OF THE INVENTION

It would be desirable to provide a visually exciting component to the playing of an instrument in a performance such as a performance by a marching band or drum and bugle corps.

In one aspect the present invention provides for a horn support device for hand-carrying a horn having a horn-securing bracket or mount attached firmly to a horn body at or near a central position of said horn. A further aspect of the present invention provides for a grip attached to the horn-securing bracket for allowing support of said horn in a single hand.

Yet another aspect of the present invention provides that the aforementioned grip is rotatably attached to said bracket permitting a rotary motion of said horn relative to said grip. Yet a further aspect of the present invention is providing for selectively permitting rotation of said horn.

DETAILED DESCRIPTION OF THE PREFERRED EMBODIMENTS

Figure 1:
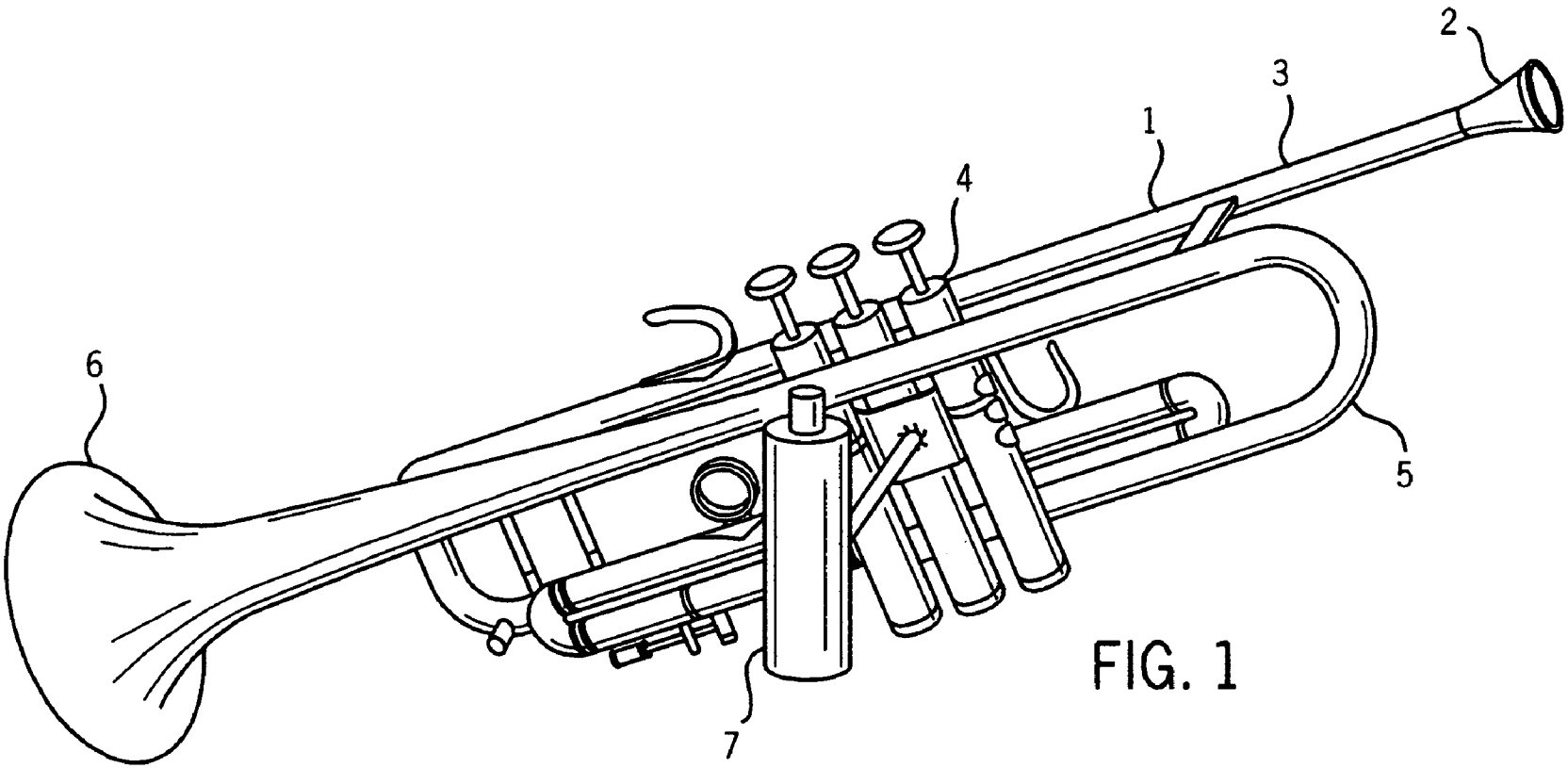
FIG. 1 demonstrates an embodiment of the invention.

The present invention is directed to a horn support device which provides rotary motion. In FIG. 1, a horn such as a trumpet 1 is shown, having a mouthpiece 2 disposed within lead pipe 3. One or more valves 4 control airflow within trumpet 1. A tube 5 expands gradually along its length into a flared bell 6.

Figure 2:
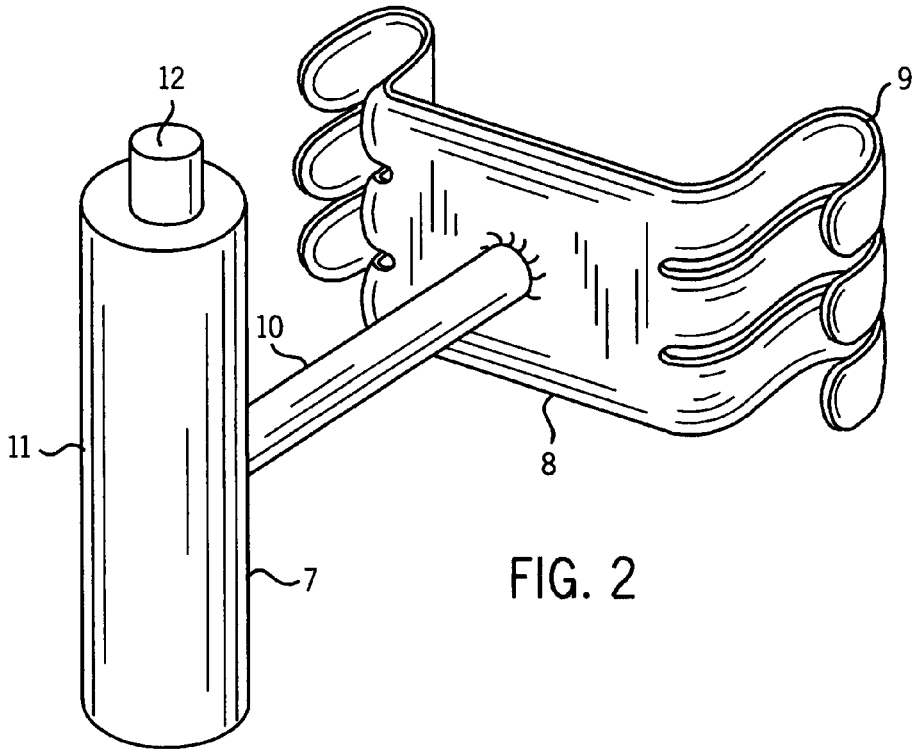
FIG. 2 demonstrates an embodiment of the invention.

The horn support device 7 is shown in an installed operating position on trumpet 1, and is shown in additional detail in subsequent figures. As shown in FIG. 2, horn support device 7 includes, broadly, a mount 8, arm 10 and grip 11. Mount 8 is arranged to connect to the horn, and provide a firm mounting thereto. One or more fingers 9 provide a spring or flexible mounting structure which permits mount 8 to be inserted between one or more valves 4, in the embodiment shown in FIG. 1. In an embodiment, mount 8 is formed of a plastic material. In yet another embodiment mount 8 is formed of metal, which may optionally be provided with a coating or treatment to provide for a smooth, pliable surface for preventing damage to the horn. Mount 8 may alternatively be formed of any material of sufficient strength and rigidity to reliably carry the weight of the horn, or optionally mount 8 may be formed integrally with the horn itself.

Arm 10 of horn support device 7 is mounted or connected at a first end to mount 8. At a second end, arm 10 connects to grip 11. Arm 10 may be formed out of wood, metal or plastic, or a combination, or such other material as desired, in order to reliably carry the full weight of the horn. Arm 10 provides for an extension of the grip 11 away from mount 8 in part in order to provide clearance between the hand of the user and mount 8. Further, arm 10 is disposed at any desirable angle from mount 8 in order to provide an appropriate ergonomic angle for the user.

Grip 11 is gripped by the user to support the horn, when the horn is held in a single hand, or jointly by one hand on grip 11 and the other on the horn. In an embodiment, grip 11 is shaped in a generally cylindrical form, and may contain additional contours for providing a more secure grip. Additional contours forming a pistol-style grip, or a joystick style grip, may be optionally added. A release 12 extends from an end of grip 11.

Figure 3:
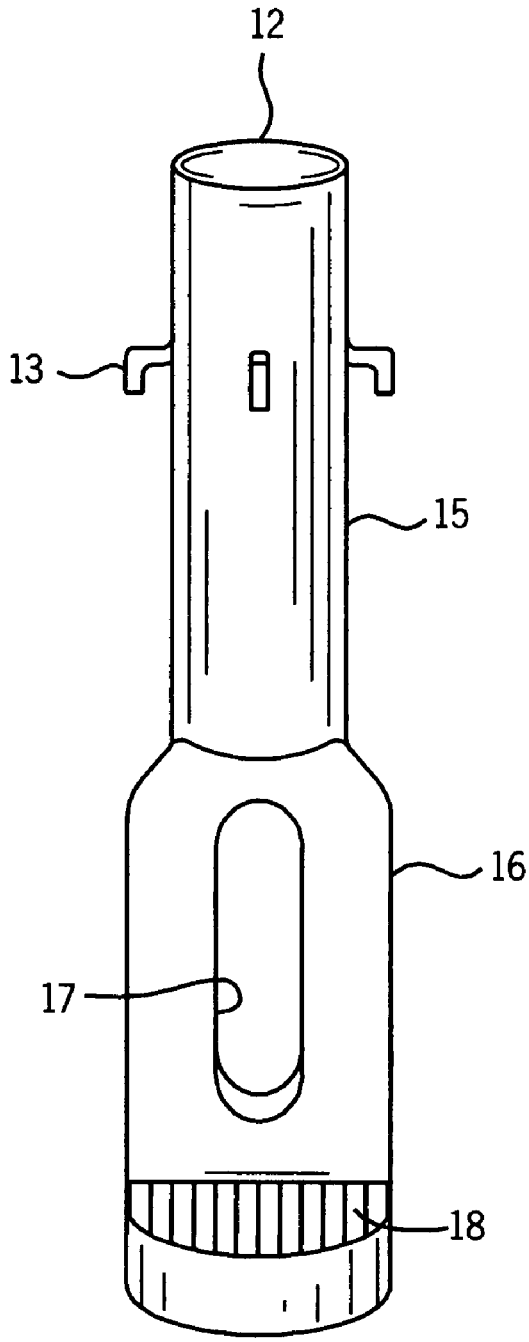
FIG. 3 demonstrates an embodiment of the invention.

As shown in FIG. 3, release 12 includes a plurality of retainers 13 for securely positioning a spring in relationship to release 12. A generally cylindrical portion 15 flares broadly into a widened portion 16, which portion 16 includes a central elongate opening 17. Release 12 further includes a high-friction surface 18.

Figure 4:
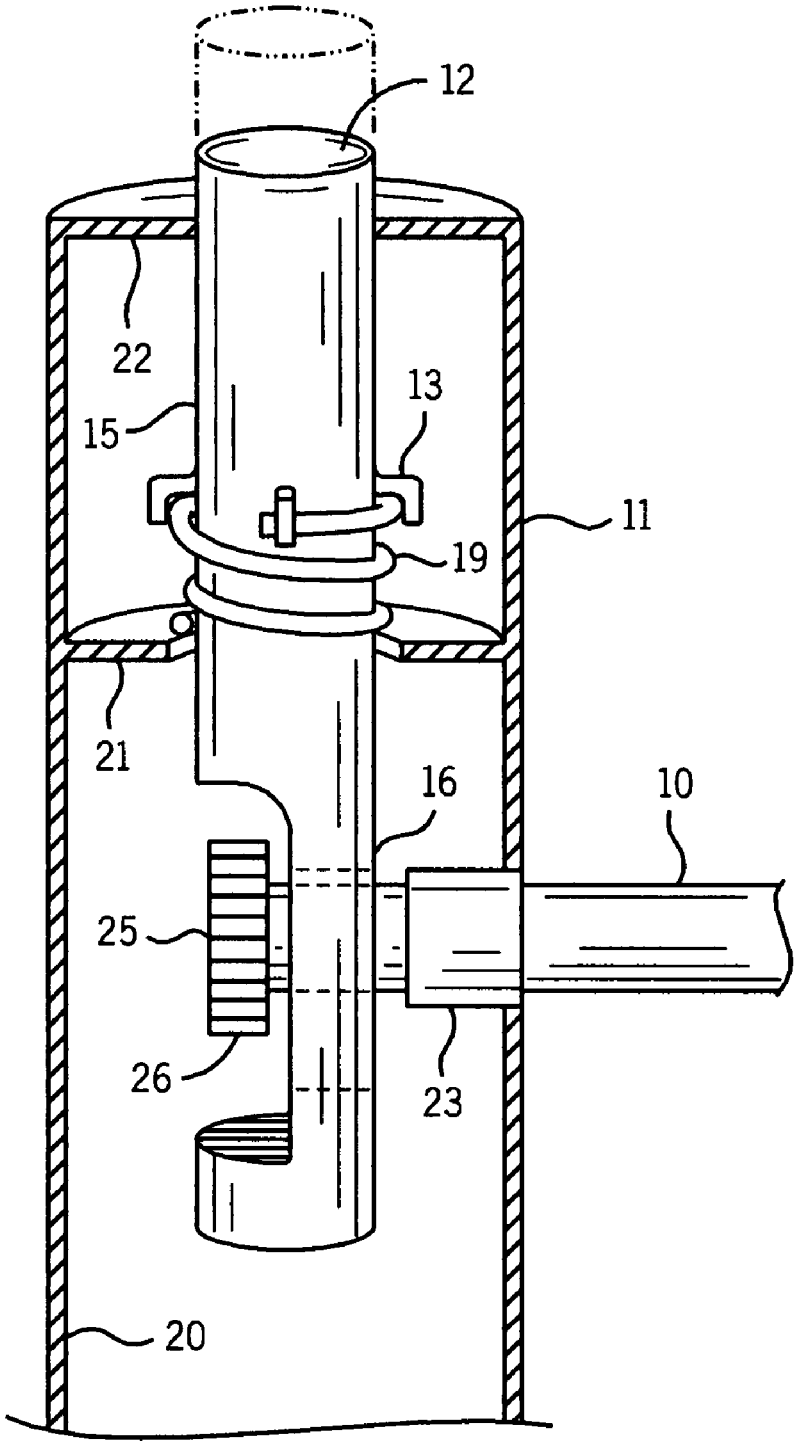
FIG. 4 demonstrates an embodiment of the invention.

FIG. 4 shows, in a cutaway view, the internal aspects of grip 11 including release 12 which is shown in a side view. Release 12 is contained in grip 11 as defined by an upper wall 22 and side wall 20. Internal wall 21 serves as a retainer for spring 19. Arm 10 extends through an opening in side wall 20, through bearing 23 into the interior of grip 11. Arm 10 extends through opening 17 of release 12, ending in a friction wheel 25. The external surface 26 of friction wheel 25 or high-friction surface 18 may desirably be formed of a high friction, durable material such as is well known in the clutch or brake fields, or one or both of friction wheel 25 or high-friction surface 18, as shown in FIGS. 3 and 4, may have an outer formation of parallel teeth or grips for releasable engagement.

The horn may be held normally with two hands. One hand may hold grip 11 and the other may hold the horn in any desired location, typically in such a location which enables the user to actuate valves 4. When desired, the user may hold the horn with one hand using grip 11, and depress release 12.

When the horn is held away from the user's body by grip 11, the horn may be rotated while release 12 is depressed, producing a desirable spinning motion in the horn. The spinning motion may continue until stopping of its own accord, or may be selectively ceased by release of release 12. Additionally, release 12 may be depressed by the user for any desired reason, such as in order to selectively position the grip 11 in a desired position.

It should be understood that the foregoing relates only to a limited number of embodiments that have been provided for illustration purposes only. It is intended that the scope of invention is defined by the appended claims and that modifications to the embodiments above may be made that do not depart from the scope of the claims. For example, and within the scope of the claims, for simplicity purposes release 12 may be omitted, enabling the grip to freely rotate, or the release may be placed in an alternative location. Alternatively, and also within the scope of the claims, the grip may be rotatable through less then a 360° arc for obtaining an ergonomic grip position.

What is claimed is:

1. A horn support device for hand-carrying a horn comprising:

a horn-securing bracket attached firmly to a horn body near a central position of said horn, a grip for supporting said horn in a single hand, said grip being rotatably attached to said bracket, said grip being selectively rotatable, said grip includes a spring member, said spring member selectively permitting rotary motion of said grip, said bracket includes an arm extending therefrom, said grip being rotatably mounted on said arm, said arm includes a friction wheel and said grip includes a friction member.

2. The horn support device of claim 1, wherein said friction wheel and said friction member are selectively engagable.

3. The horn support device of claim 2, wherein said bracket is detachable from said horn.

4. The horn support device of claim 2, wherein said bracket is held in position by a spring.

5. A horn having a support device for support using one hand, said horn support device comprising a horn-securing bracket attached firmly to a central position of said horn, a grip for supporting said horn in a single hand, said grip being rotatably attached to said bracket permitting a rotary motion of said horn relative to said grip, said grip being securable relative to said horn, providing for an alternate mode of use for said horn support device wherein rotary motion of said horn relative to said grip is prevented, said grip including a release and a spring member, wherein said release selectively permits rotary motion of said grip, and said spring forces said release into a non-rotating position.

* * * * *